United States Patent [19]

Riedel

[11] Patent Number: 5,052,069

[45] Date of Patent: Oct. 1, 1991

[54] FABRIC TREATMENT

[75] Inventor: Dieter Riedel, Porta Westfalica, Fed. Rep. of Germany

[73] Assignee: Johannes Menschner Maschinenfabrik GmbH & Co. KG, Viersen, Fed. Rep. of Germany

[21] Appl. No.: 509,803

[22] Filed: Apr. 17, 1990

[30] Foreign Application Priority Data

Apr. 29, 1989 [DE] Fed. Rep. of Germany ..... 3914358

[51] Int. Cl.[5] ..... D06B 5/08

[52] U.S. Cl. ..... 8/149.1; 8/149.3; 68/5 R; 134/118

[58] Field of Search ..... 8/149.1, 149.3; 68/5 R, 68/5 B, 5 D, 5 E, 8, 5 A; 34/111, 116, 118

[56] References Cited

U.S. PATENT DOCUMENTS 3,046,771 7/1962 Bailey ..... 68/5 R
3,104,954 9/1963 Griffiths et al. ..... 68/5 B X
3,885,262 5/1975 Riedel ..... 8/149.3
4,102,643 7/1978 Riedel ..... 8/149.3
4,776,186 10/1988 Riedel ..... 68/5 R

FOREIGN PATENT DOCUMENTS 0553316 6/1977 U.S.S.R. ..... 68/5 D

*Primary Examiner*—Philip R. Coe
*Attorney, Agent, or Firm*—Penrose L. Albright

[57] ABSTRACT

A process for the continuous permanent decatizing and fixing of textile materials in web form, such as woven, knitted fabrics or the like is described. In the process the textile material is damped to a range of 20 to 100%, and pressed against part of two heatable cylinders. The surface temperature of each heatable cylinder is in excess of 140° C. In a first process step the left side of the textile material is applied to the first heatable cylinder, and in a second process step the right side of the textile material is applied to the second heatable cylinder.

8 Claims, 3 Drawing Sheets

FABRIC TREATMENT

BACKGROUND OF THE INVENTION

1. Technical Field

The present invention relates to a process for the continuous permanent decatizing and fixing of textile materials in web form, such as woven or knitted fabrics or the like. The invention is particularly applicable to wool or wool mixture fabrics.

The permanent decatizing effects concerned here are particularly those effects which cannot be detrimentally affected by the use of steam ironing presses at clothing manufacturers. As is known, non-permanent decatizing effects lose their character of gloss, feel and look on steaming and pressing.

2. Prior Art

Permanent decatizing effects can be achieved as a rule only with discontinuous processing arrangements, e.g. with the aid of a decatizing boiler machine. In such processing arrangements the fabric and the backing cloth are wound together around a decatizing and treatment cylinder, and subsequently treated in an autoclave under high temperature conditions.

The drawback with such discontinuous processes is exacerbated by a further drawback, that is the effects achievable within each square—i.e. between the start and end of the material—turn out to be considerably different.

U.S. Pat. No. 4,912,792 describes a process making it possible to achieve in a continuous manner, permanent decatizing effects. Essentially, what is disclosed is the fact that chemical fixing agents have to be used in parallel with the physical effect of the decatizing, so that a permanent degree of fixing can be ensured. According to this known method the chemical fixing agents are applied with the addition of hygroscopic substances in the region of a foulard—thus at a stage before the stretching and drying process.

Immediately before the actual decatizing and fixing process an activation of the fixing agent is achieved by controlled redamping. The fixing agent activated by the damping is reacted with the application of heat and mechanical pressure in the fibre structure of the material in the region of the decatizing and fixing equipment.

Although by means of this known method permanent decatizing effects are achieved with a continuous operation, this method has not so far been able to establish itself to a great extent because many users, e.g. cloth makers or the like are reluctant to use chemicals, particularly avoiding this in the region of the drying equipment. A further drawback lies in the cost of constant procurement of these chemical fixing agents. For countries which are poor in hard currency there is the problem of obtaining chemicals.

SUMMARY OF THE INVENTION

It is the object of the invention to achieve a permanent decatizing and fixing effect using a continuous process, which process does not require chemicals of any kind, it not mattering which side of the textile materials is presented, i.e. either the left or the right side.

This object is achieved with a process of continuous permanent decatizing and fixing of textile materials in web form including a first process step in which damped textile material is passed over a first rotatably mounted heatable cylinder, the material being pressed against part of the cylinder surface by means of an impermeable pressure band, and a second process step in which the material is passed over a further rotatably mounted heatable cylinder, the material being pressed against part of the further cylinder surface by means of a further impermeable pressure band, wherein the textile material is damped within a moisture range of 20 to 100%, and the surface temperatures of said parts of said surfaces of said first and further cylinders are maintained above 140° C. and wherein a first side of the textile material is applied to the first heatable cylinder in the first process step and the opposite side of the textile material is applied to the further heatable cylinder in the second process step.

In one embodiment of the method in accordance with the invention the textile material is damped so as to have a moisture content range of 20 to 35%, and the material is also wetted in the second treatment step.

Appropriately, the moisture of the textile material as well as the surface temperature of the heatable cylinder are adjustable independently of each other in the two treatment steps.

In practice this means that, for example for the treatment of the left side of the textile material, the process is conducted in the first treatment step at a higher surface temperature of the heatable cylinder than the surface temperature of the heatable cylinder in the second treatment step.

It is also possible to operate with differing moisture content values in the first and second treatment steps, and, corresponding to the utilization of higher fixing temperatures an increased amount of moisture should be used to prevent damage to the fibres of the material or yellowing.

A third treatment step may be included, depending on requirements, as a finishing decatizing, when gloss, volume and feel can be improved or corrected. Such a finishing treatment is carried out on the same decatizing machine; however, in this instance, the textile material is allowed to come only directly in contact with the surface of the heatable cylinder.

For specific textile material qualities a treatment with the first and second treatment steps is adequate. However, in this case, it would be appropriate for the textile material leaving the second treatment step to pass into a suction station.

The pressure band acting on the textile material is impermeable to the agents used in the processing, as a consequence of which the amount of moisture introduced into the textile material is converted into steam by means of the heating of the cylinder and of the pressure band. By a corresponding selection of surface temperature of the heatable cylinder and of the pressure band it is also possible to select the temperature of the textile material to such a high degree that permanent fixing effects can arise under high temperature conditions. This effect is based on the recognition of the fact that, even when higher contact temperatures are used, e.g. up to 160°-180° C., no damage or yellowing is suffered by the textile material, provided that adequate moistening of the textile material is ensured.

As opposed to this, damage occurs when woollen material that is too dry is exposed to too high a temperature. In other words, this means that wool material should never be exposed with under 10-12% moisture content to a temperature in excess of 120° C.

In a process in accordance with the invention, contrary to prior art processes, operations are carried out with the textile material having controllable moisture contents. This important factor fell short hitherto in previous decatizing methods. Generally, it was always believed that moisture entered the material through steam. However, the contrary is precisely the case as in fact, steam dries out the textile material. Measurements reveal a loss of moisture in the material of about 2–3% in a normal decatizing process.

The decatizing and fixing process of the invention is based on the fact that the damp state of the textile material to be treated can be individually corrected and influenced before each process step by an effective damping device. In this connection it has been found to be particularly effective if the damping device is constructed of a combination of an open steaming means such as a steam lock and a means for producing a fine water mist in direct contact with the textile material.

By means of the open steaming, initially the textile material and the enclosed air (in the pores) are heated in the same process, so that with the subsequent spraying a considerably greater amount of water can be offered before the dew point limit is reached.

The textile material, or the air spaces in it, so heated absorbs moisture more quickly and rapidly than when a cold material surface is sprayed. The significance of the moisture content of the textile material, however, is not restricted to the degree of fixing only; in fact, by varying the intensity of the degree of moistening further parameters, essential to the decatizing effect, can be positively influenced. These are:

1) Influencing the thickness or the volume of the textile material, with modifications of the moisture content of the material. (More moisture in the material leads to more voluminous material and therefore to a softer feel).

2) Influencing the gloss of the textile material with modifications of the moisture content. (More moisture in the material leads to a duller material, less gloss development and finally to a gentler gloss).

In practical use rotor damping units have been found to be particularly suitable for the atomizing of the finest water mist.

Moistening of the material by spraying or the like may also be performed by direct dipping of the material in a preheated water bath. The material is then completely soaked and subsequently squeezed down to about 80–85% moisture content in a squeezing apparatus. In this state there is now effected the first treatment step on the left side of the textile material. With this wet fixing, by means of the steam conversion in the region between the heatable roller and the pressure band of the first process step, a reduction of the material's moisture content from 85 to about 40–48% is achieved. During the following treatment of the right side of the material in the second process step there takes place already a reduction of moisture to about 17–20%, so that in principle the desired residual moisture is achieved immediately after the second treatment step.

An immediately succeeding last finishing decatizing treatment can only further increase the aimed fixing effect with respect to gloss, volume, feel and structure.

It is appropriate, in the process of the invention, for the heating of the roller and of the pressure band to be supplied by oil closed circuit heating, because, with the steam pressure values usual in practice, the higher temperatures required for the process of the invention are, as a rule, not achieved.

The heat flow achieved by means of the oil circulation guarantees a considerably higher accuracy of the required temperature values.

A process in accordance with the invention, together with apparatus for carrying out the process is described below in greater detail on the basis of the drawings.

DESCRIPTION OF PREFERRED EMBODIMENTS

Figure 1:
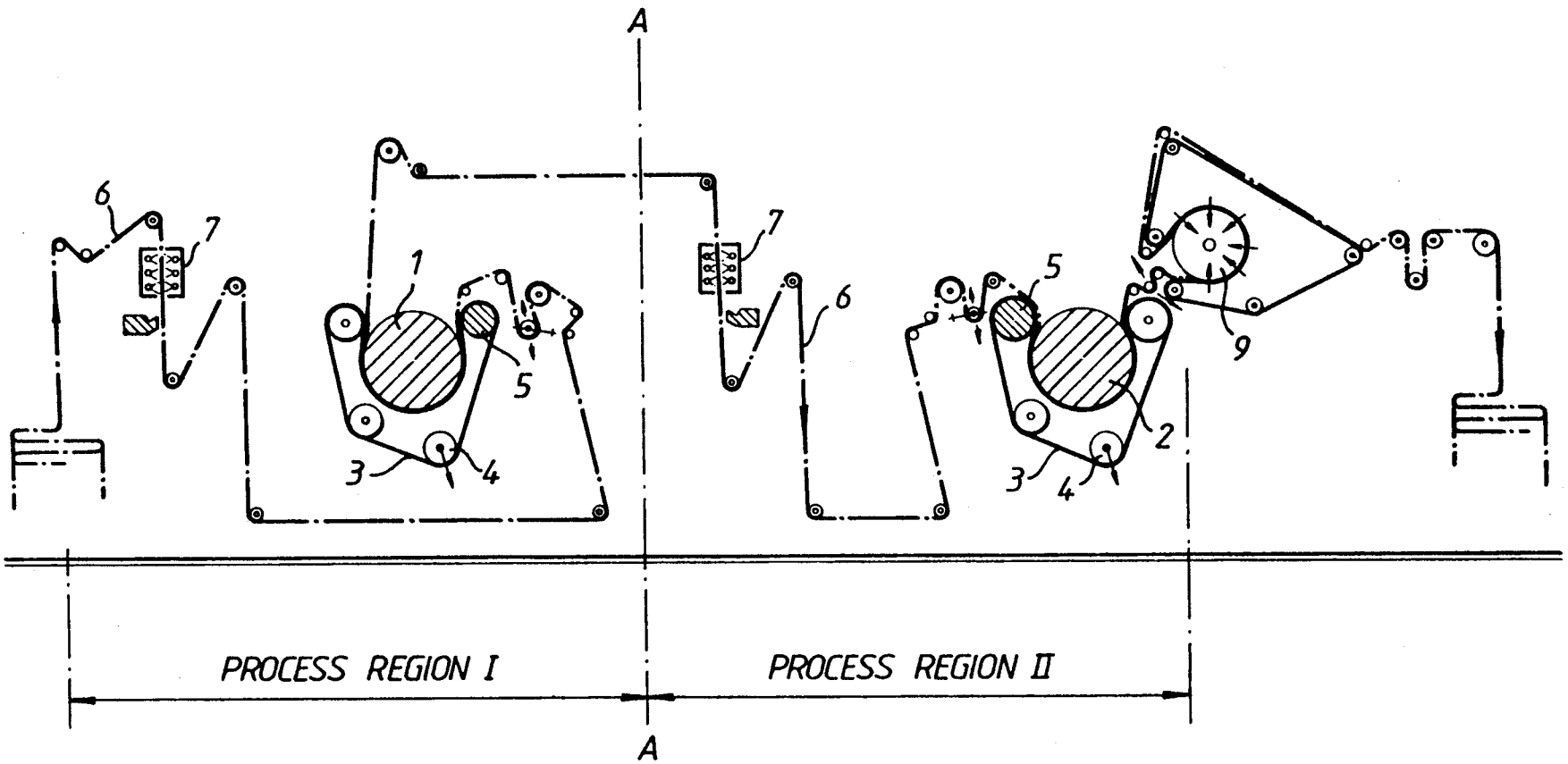
FIG. 1 is a diagrammatical view of process regions I and II in one embodiment of apparatus for performing a process in accordance with the invention.
Figure 4:
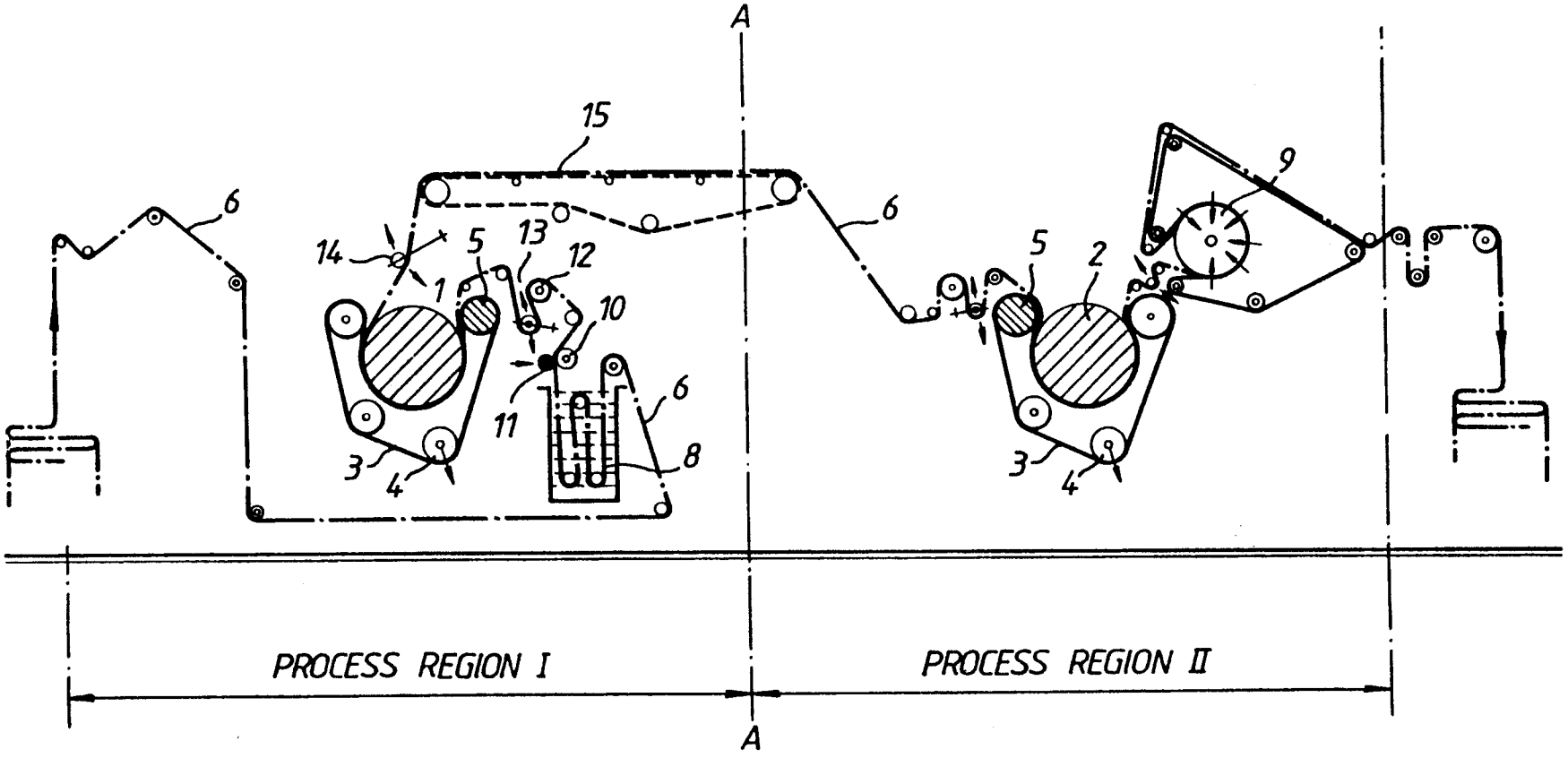
FIG. 4 is a view of the process regions I and II in a second embodiment of apparatus for performing a process in accordance with the invention, wherein a damping unit is used designed for a 100% wetting of the textile material before entering the decatizing unit.

I and II in FIGS. 1 and 4 denote the two process regions in which the first and second process steps of the invention are performed. 1,2 denote heatable cylinders with closed smooth surfaces which are heated in a suitable manner such that their surface temperature is in excess of 140° C. Furthermore, 3 denotes an agent impermeable pressure band which is passed over a part of the associated heatable cylinder 1,2 as well as over the guide rollers.

With respect to the guide rollers, 4 denotes a tension roller, while the guide roller 5 is heatable independently of the cylinder 1 or 2. The heated guide roller 5 is intended to heat the pressure band 3.

The textile material 5 is guided by the part of the cylinder 1 or 2 over which the pressure band 3 passes in such a manner that the material comes to lie between the part of the cylinder 1 or 2 and the pressure band 3. Before the introduction of the textile material 6 into the gap between the pressure band 3 on the one hand and the heatable cylinder 1 or 2 on the other hand the textile material is passed through a damping unit 7 or 8.

Figure 2:
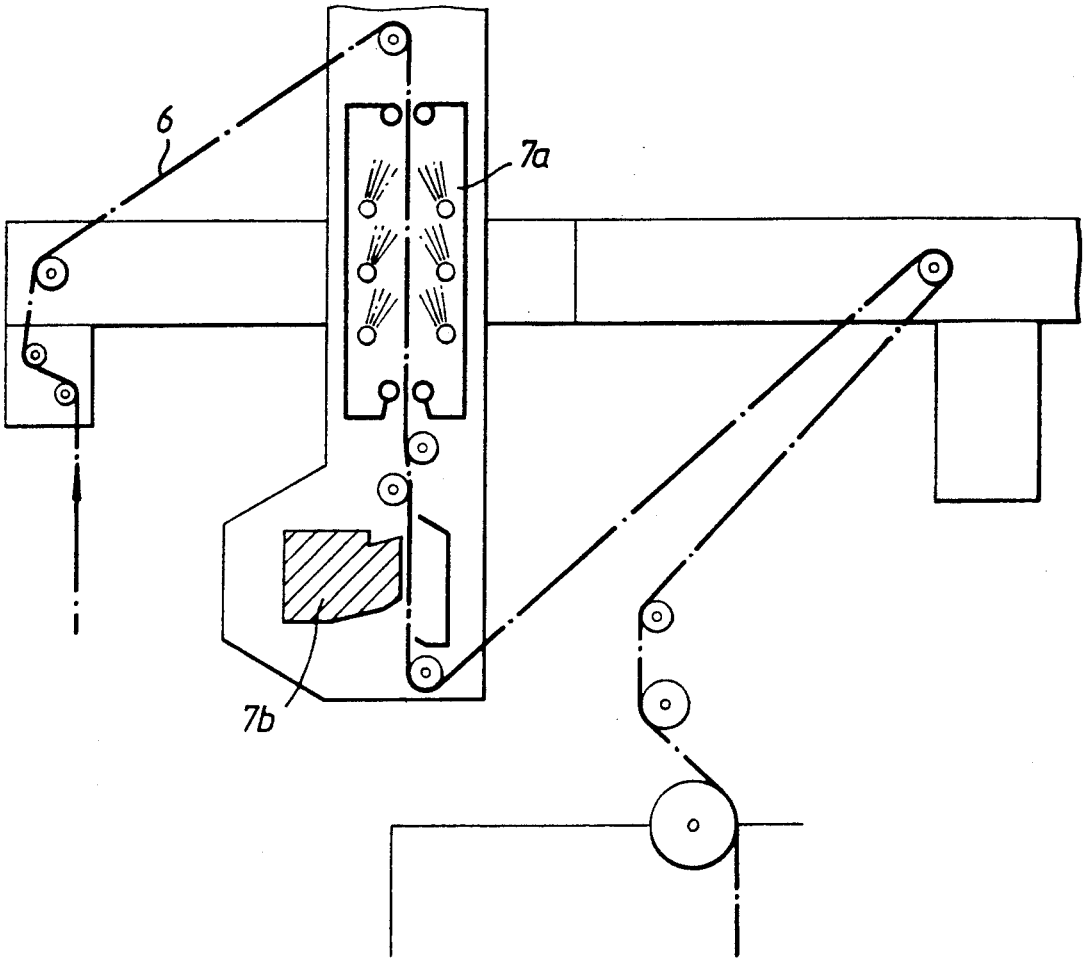
FIG. 2 is a section on a larger scale of the damping unit used in the apparatus of FIG. 1.

In the representation of FIG. 1 a damping unit 7 is provided in each of the two process regions I and II. FIG. 2 of the drawings shows details of an appropriate embodiment of the damping unit 7. There, this unit consists of a steam lock 7*a* with a rotor spraying unit 7*b* mounted directly after it, it being possible to adjust the intensity of the damping by regulating the pressure and amount of water. A regulation of the corresponding desired value parameters can also be effected automatically, and in fact independently of the nature of the textile material, but depending on its speed.

Figure 3:
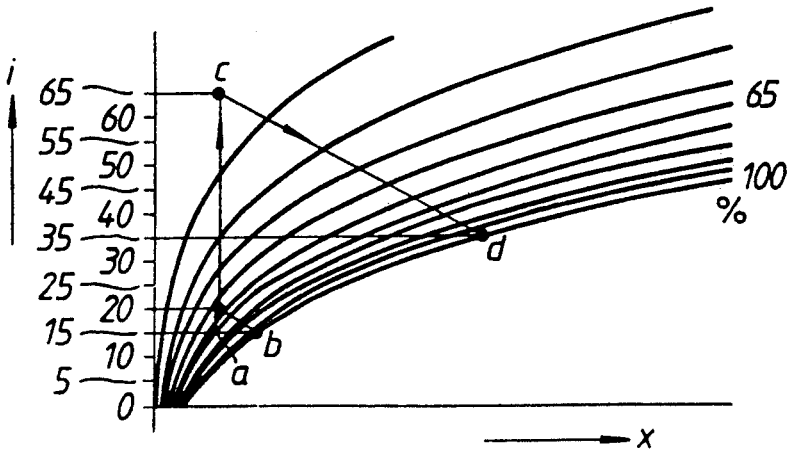
FIG. 3 is an illustration of the working principle of the damping unit of FIG. 2 in a Mollier-i-x diagram.

Referring to the Mollier-i-x diagram shown in FIG. 3, it will be easy to recognize the advantages between moistening and the water spraying directly following it.

As a result of directing steam onto the textile material a warming of the material occurs (points a to c) and at the same time the relative moisture of the pore volume in the textile material 6 decreases. In this condition it is possible to offer up to the textile material 6 a very great amount of water (points c to d), before the dew point for 100% saturation is reached. It will also be easily recognized why a spraying of cold textile materials 6 (points a to b) is relatively ineffective. A low amount of water leads already at that stage to the formation of dew and drops, which is also clearly confirmed by practice.

As a fabric has up to 80% pore volume, the effect of the air evenly distributed in the fabric and its damping will lead to a good damping effect, and indeed also in the goods to be fixed.

The textile material leaving process area I is introduced into the following process region II which, in the embodiment of FIG. 1, contains the same units as process region I. However, it is essential that in the two embodiments according to FIGS. 1 and 4 the heatable cylinder 2 should be arranged as a mirror image of the heatable cylinder 1, the mirror plane being denoted by A—A. By this means it is arranged that the textile material 6 lies in process area I with its left side, and in process region II with its right side, on the respective heatable cylinder 1,2. This ensures that the materials come out evenly.

If required, the textile material 6 at the end of process region II may be despatched to a suction station which is shown in FIG. 1 by reference FIG. 9.

The embodiment of FIG. 4 differs from that of FIG. 1 in that a damping unit 8 is provided only in process region I in which the textile material 6 is subjected to a 100% moistening. This damping unit 8 consists of a hot water trough, the driven roller 10 taking over the transport of the textile material 6.

By means of a squeezing roller 11 water in excess of about 85% residual moisture is squeezed away. A jockey unit 13 mounted behind the driven feed roller 12 provides for a low-tension run of the goods 6 into the decatizing machine of process region I.

This drive means ensures the avoidance of dangerous stretching moments in the textile material 6 which arise during the passage thereof as a consequence of the hot water treatment.

Because of the high surface pressure forces acting on the textile material 6 in the region of the heatable cylinder 1 there will be observed, as a result of the supply of heat on both sides, a heat transfer value that is so high that the textile material 6, after it has passed through process region I, has now been reduced in its moisture content from about 85% to 40–48%.

Evaporation takes place as soon as the textile material 6 leaves the cylinder 1.

A finely sensitive jockey device 14 scans the material 6 without application of pressure and ensures an automatic regulation of the material transport, taken over by a carrier belt 15. From here a low tension transport effects transfer of the textile material to process region II where the right hand side of the material undergoes the fixing treatment.

I claim:

1. A process of continuous permanent decatizing and fixing of textile materials in web form including a first process step in which damped textile material is passed over a first rotatably mounted heatable cylinder, the material being pressed against part of the cylinder surface by means of an impermeable pressure band, and a second process step in which the material is passed over a further rotatably mounted heatable cylinder, the material being pressed against part of the further cylinder surface by means of a further impermeable pressure band, wherein the textile material is damped within a moisture range of 20 to 100%, and the surface temperatures of said parts of said surfaces of said first and further cylinders are maintained above 140° C., and wherein a first side of the textile material is applied to the first heatable cylinder in the first process step and the opposite side of the textile material is applied to the further heatable cylinder in the second process step.

2. A process according to claim 1, wherein the textile material is damped within a moisture range of 20–35%, said textile material being damped before it passe over the first cylinder and before it passes over the further cylinder.

3. A process according to claim 2, in which the moisture content of the textile material and the surface temperature of the first and further heatable cylinders, during the first and second process steps, are adjustable independently.

4. An apparatus for the continuous permanent decatizing and fixing of textile material in web form, including a first rotatably mounted heatable cylinder, a first impermeable pressure band arranged to press the textile material against part of the first cylinder surface, a further rotatably mounted heatable cylinder, a further impermeable pressure band arranged to press the textile material against part of the further cylinder surface, a damping unit effective to damp the textile material within a moisture range of 20–100%, and means for heating the cylinders such that their surface temperature is above 140° C., wherein the first and further cylinders are arranged such that a first side of the textile material is applied to the first heatable cylinder and the opposite side of the textile material is applied to the further heatable cylinder.

5. An apparatus according to claim 4, in which the damping unit comprises a first damping device upstream of said first cylinder, and a further damping unit upstream of said further cylinder.

6. An apparatus according to claim 5, in which each said damping device comprises an open steaming unit and a means for producing a fine water mist.

7. An apparatus according to claim 4, in which the damping unit comprises a hot water trough upstream of said first cylinder and a squeezing means effective to remove excess water from the textile material.

8. An apparatus according to claim 4, including means for independently adjusting the moisture content of the textile material before it passes over the first cylinder, and before it passes over the further cylinder.

* * * * *